US011178492B2

(12) United States Patent
Mauriac

(10) Patent No.: US 11,178,492 B2
(45) Date of Patent: Nov. 16, 2021

(54) LOUDSPEAKER WITH A DIAPHRAGM STIFFENING GRID

(71) Applicant: Jean Mauriac, Paris (FR)

(72) Inventor: Jean Mauriac, Paris (FR)

( * ) Notice: Subject to any disclaimer, the term of this patent is extended or adjusted under 35 U.S.C. 154(b) by 22 days.

(21) Appl. No.: 16/622,696

(22) PCT Filed: Jun. 15, 2018

(86) PCT No.: PCT/EP2018/065919

§ 371 (c)(1),
(2) Date: Dec. 13, 2019

(87) PCT Pub. No.: WO2018/229242

PCT Pub. Date: Dec. 20, 2018

(65) Prior Publication Data

US 2020/0120425 A1 Apr. 16, 2020

(30) Foreign Application Priority Data

Jun. 15, 2017 (FR) ..... 17 55408

(51) Int. Cl.
*H04R 7/26* (2006.01)
*H04R 9/06* (2006.01)
*H04R 7/12* (2006.01)

(52) U.S. Cl.
CPC ..... *H04R 7/26* (2013.01); *H04R 7/125* (2013.01); *H04R 9/06* (2013.01)

(58) Field of Classification Search
CPC ..... H04R 7/26; H04R 7/125; H04R 9/06
See application file for complete search history.

(56) References Cited

U.S. PATENT DOCUMENTS 4,100,992 A 7/1978 Rehde et al.
8,942,407 B2 * 1/2015 Dodd ..... B26B 21/521 381/398
9,398,376 B2 * 7/2016 Noro ..... H04R 9/06
2009/0226028 A1 * 9/2009 Suganuma ..... H04R 7/26 381/430
2013/0070953 A1 3/2013 Dodd et al.

OTHER PUBLICATIONS

International Search Report dated Aug. 20, 2018 for French Application . PCT/EP2018/065919.
Written Opinion of the International Search Authority for PCT/EP2018/065919 dated Aug. 20, 2018.

* cited by examiner

*Primary Examiner* — Brian Ensey
(74) *Attorney, Agent, or Firm* — B. Aaron Schulman, Esq; Stites & Harbison, PLLC

(57) ABSTRACT

A loudspeaker is provided having a frame, a device for generating a magnetic field in a magnetic circuit exhibiting an air gap, turns of conductive materials for moving in the air gap, a diaphragm rigidly connected to the turns of the conductive materials that moves in a direction of movement with respect to the frame, the diaphragm having an inner face and an outer face. The inner face of the diaphragm is positioned to face the frame, and the loudspeaker also contains ag rid that stiffens the diaphragm and is shaped to allow the grid to be glued to the outer face of the diaphragm. The grid glued on the diaphragm forces the diaphragm to execute the movements of the turns of conductive materials. The diaphragm obeys impulses given by the turns of the conductive materials, reproduces them identically and transmits vibrations to the air without creating parasitic standing waves.

13 Claims, 4 Drawing Sheets

LOUDSPEAKER WITH A DIAPHRAGM STIFFENING GRID

BACKGROUND OF THE INVENTION

Field of the Invention

The present invention relates to a loudspeaker.

In the field of electrodynamic loudspeakers, the sound is generated by a diaphragm of the loudspeaker. More specifically, the diaphragm is able to move at a desired vibration frequency, the movement generating pressure waves that correspond to the sound to be emitted.

Description of Related Art

However, during the movement of the diaphragm, the diaphragm can be the seat of standing waves. These standing waves usually have a different frequency from the desired vibration frequency. The standing waves are therefore, from the perspective of the sound to be emitted, unwanted frequencies.

As a result, the sound reproduction quality of the loudspeaker is limited by the presence of the standing waves in the diaphragm.

Document US 2013/0070953 A1 describes a loudspeaker having a diaphragm comprising a molded part and an attached shaped part. The molded part is a radiating surface with stiffening ribs and the shaped part is a thin material surface, fastened to the back of the ribs.

U.S. Pat. No. 4,100,992 A also describes a loudspeaker comprising a porous diaphragm having an outer edge, the diaphragm being completely impregnated with a material in the area located between a ring arranged at the function between the diaphragm and drive means and the outer edge of the diaphragm without increasing the thickness of the diaphragm.

Lastly, document US 2009/0226028 A1 also describes a loudspeaker having a diaphragm comprising a frame element and filler elements filled in the frame element. The frame element is made up of solid plates that are all arranged parallel to the vibration direction and radially from the center of the diaphragm toward the outer circumference. The plates are fastened together at the radial center and are fastened to a driving part. The sound is emitted by the filler elements.

These loudspeakers are not fully satisfactory. In particular, these loudspeakers are complex to manufacture.

There is therefore a need for a loudspeaker having a better sound reproduction quality and that is easier to manufacture.

BRIEF SUMMARY OF THE INVENTION

To that end, the present description in particular relates to a loudspeaker comprising a frame, a device suitable for generating a magnetic field in a magnetic circuit exhibiting an air gap, turns of conductive materials suitable for moving in this air gap, a diaphragm that is rigidly connected to the turns of conductive materials and that is capable of moving in a direction of movement with respect to the frame, the diaphragm having an inner face and an outer face, the inner face of the diaphragm being positioned facing the frame, and a grid that is intended to stiffen the diaphragm, the shape of the grid allowing the grid to be glued to the outer face of the diaphragm.

The grid makes it possible to stiffen the diaphragm and thus to obtain a good sound reproduction quality.

Furthermore, the loudspeaker is particularly easy to manufacture relative to the loudspeakers of documents US 2013/0070953 A1, U.S. Pat. No. 4,100,992 A and US 2009/0226028 A1.

Indeed, in document US 2013/0070953 A1, the stiffened diaphragm is particularly complex to manufacture, since ribs formed in a single piece with the diaphragm are made. Furthermore, the ribs are formed on an inner face of the diaphragm.

In document U.S. Pat. No. 4,100,992 A, the diaphragm is obtained after impregnation of predefined areas. The diaphragm is therefore complex to manufacture, since tedious impregnation operations are carried out.

Lastly, in document US 2009/0226028 A1, the loudspeaker does not comprise a membrane, but a diaphragm having a complex structure relative to a simple diaphragm on which an independent grid is attached.

Unlike the three aforementioned documents, in the present invention, a grid independent of the diaphragm is added on the outer face of the diaphragm.

Adding the grid on the outer face of the diaphragm does not involve any modification to the structure of the loudspeaker. It suffices to attach and glue the grid on the outer face of the diaphragm. Additionally, positioning the grid on the outer face of the diaphragm facilitates the placement of the grid due to the immediate access to the outer face of the diaphragm. Furthermore, being able to access the grid directly makes it possible to simplify the repair of the grid without having to disassemble the diaphragm from the loudspeaker.

According to specific embodiments, the loudspeaker comprises one or more of the following features, considered alone or according to any technically possible combinations:

- the outer face of the diaphragm has a surface, called total surface, the grid delimits portions of the outer face of the diaphragm, each portion having a surface of less than or equal to 25% of the total surface, preferably less than or equal to 20% of the total surface, and advantageously less than or equal to 10% of the total surface.
- the grid delimits portions of the outer face of the diaphragm, the number of portions being greater than or equal to 10.
- the grid delimits portions of equal surface at least over part of the outer face of the diaphragm.
- the grid is formed by the nesting of several plates.
- the grid comprises at least two nested plates.
- the grid verifies at least one of the following properties:
  - a first property according to which the plates are parallel to a first direction or a second direction, the two directions being perpendicular to one another and perpendicular to the movement direction,
  - a second property according to which the plates are concurrent at a same point in space, and
  - a third property according to which the grid has a honeycomb shape in a section transverse to the movement direction.
- each plate is made from a material, the material of each plate is chosen from the group of materials made up of: paper, graphite paper, bristol board, cardboard, wood, polystyrene, polystyrene foam, expanded polystyrene, polypropylene, polypropylene foam, polyester, polymethyl methacrylate, a plastic material, Kevlar, glass, fiberglass, carbon fibers, cellulose fibers, banana fibers, and an aerogel.
- each plate is made from a same material.

the plates define between them through spaces of the grid, each through space being delimited by a wall and at least one of the walls having at least one opening.

the grid comprises a set of walls delimiting through spaces of the grid, each through space comprising an inner passage, a first side and a second side, the second side delimiting a second outer surface facing the outer surface of the diaphragm and the first side delimiting a first outer surface opposite the second outer surface.

the diaphragm and the grid are separate.

BRIEF DESCRIPTION OF THE SEVERAL VIEWS OF THE FIGURES

Other features and advantages of the invention will appear upon reading the following description of embodiments of the invention, solely as an example and done in reference to the drawings, which are.

DETAILED DESCRIPTION OF THE INVENTION

Figure 1:
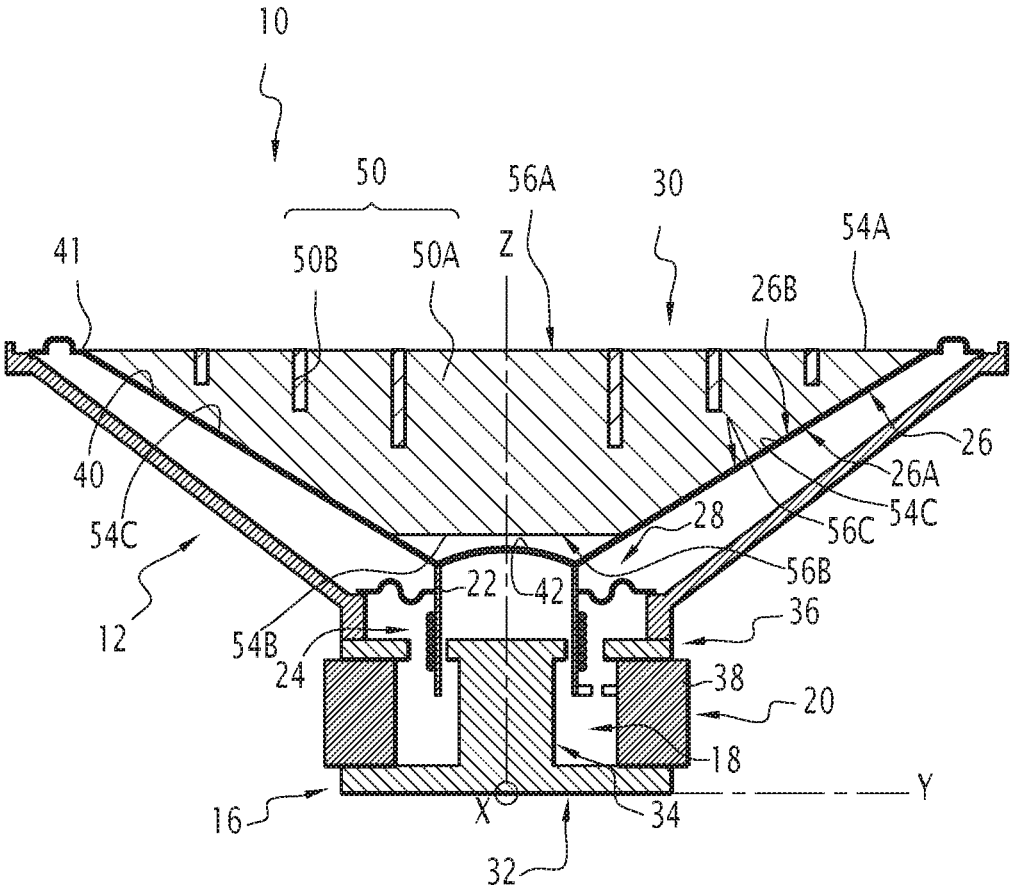
FIG. 1, a sectional view of a loudspeaker according to one example, comprising a grid, FIG. 2, a view of part of the loudspeaker of FIG. 1, FIGS. 3 and 4, front views of plates forming the grid, and FIG. 5, a top view of part of a loudspeaker according to another example.

A loudspeaker 10 is shown in FIG. 1.

A loudspeaker is a device converting an electrical signal into a sound signal to be diffused. The loudspeaker 10 includes a frame 12, a magnetic circuit 16 exhibiting an air gap 18, a device 20 suitable for generating a magnetic field, a guide tube 22, turns 24, a diaphragm 26 and a grid 30.

The assembly of the turns 24, the guide tube 22 and the diaphragm 26 forms a piece of equipment 28 moving relative to the frame 12 along a direction that is referred to hereinafter as "movement direction" and that corresponds to the movement direction of the diaphragm 26. The movement direction is symbolized by the axis Z in FIG. 1. The axis Z is further an axis of symmetry of the loudspeaker 10.

Further defined in the present description is a longitudinal direction, perpendicular to the movement direction Z and perpendicular to the plane of FIG. 1. The longitudinal direction is symbolized by an axis X in FIG. 1. In the remainder of the description, the longitudinal direction is denoted longitudinal direction X.

Also defined is a transverse direction perpendicular to the movement direction Z and to the longitudinal direction X. The transverse direction is symbolized by an axis Y in FIG. 1. The remainder of the description, the transverse direction is denoted transverse direction Y.

The frame 12 is a stationary frame that supports all of the other elements of the loudspeaker 10.

The frame 12 is also called "basket assembly".

The frame 12 has, in section, a circular shape, when the section is transverse to the movement direction Z.

In a variant, the frame 12 has an elliptical shape in a section transverse to the movement direction Z.

The magnetic circuit 16 includes a yoke 32, the yoke 32 comprising a central core 34 and an upper plate 36.

The volume of air between the central core 34 and the upper plate 36 defines the air gap 18, with a toroidal shape arranged along the movement direction Z.

The device 20 is able to generate a magnetic field in the magnetic circuit 16.

According to the example of FIG. 1, the device 20 capable of generating a magnetic field is a toroidal magnet 38.

The magnet 38 is gripped between the yoke 16 and the upper plate 36.

The guide tube 22 is extended by the diaphragm 26.

The turns 24 are made from conductive material and are able to move in the air gap.

The turns 24 are wound around the tube 22 and are secured thereto.

The turns 24 are electrically connected to one another in order to form a coil. The turns 24 are successively arranged along the movement direction Z.

In a variant, the turns 24 form several coils.

The turns 24 are suitable for being traveled by a current depending on the sound signal to be diffused. This current comes from a control module (not shown in the figures) connected on the one hand to a signal source to be diffused (not shown in the figures) and on the other hand to the turns 24. The turns 24 present in the air gap 18 experience Laplace forces that cause these turns 24 to move along the movement direction Z.

Using the tube 22, the diaphragm 26 is secured to the turns 24 and able to move along the movement direction Z relative to the frame 12.

The diaphragm 26 has an inner face 26A and an outer face 26B.

The inner face 26A is arranged across from the frame 12.

The inner face 26A is thus inserted between the outer face 26B and the air gap 18.

In the remainder of the description, the direction going from the diaphragm 26 toward the air gap 18 is called "inner", contrary to the direction going from the air gap 18 toward the diaphragm 26, which is called "outer".

The outer face 26B has a side part 40 and a bottom 42. The bottom 42 of the outer face 26B of the diaphragm 26 corresponds to the outer face of the dome of the loudspeaker 10, also called "dust cover". The dome of the loudspeaker 10 is suitable for protecting the moving equipment 28.

The side part 40 surrounds the bottom 42 and has a substantially frustoconical shape.

Thus, the side part 40 has, in section, a substantially trapezoidal shape, when the section is transverse to the longitudinal direction X.

In a variant, the side part 40 has, in section, a substantially parabolic shape, when the section is transverse to the longitudinal direction X.

In a variant, the side part 40 has, in section, a substantially hyperbolic shape, when the section is transverse to the longitudinal direction X.

The side part 40 includes a peripheral end 41.

The peripheral end 41 corresponds to a free end of the side part 40.

The peripheral end 41 is secured to the frame 12.

The peripheral end 41 has a substantially circular shape.

In a variant, the peripheral end 41 has an elliptical shape.

The diameter of the loudspeaker 10 is defined as being the diameter of the peripheral end 41.

Within the meaning of the present application, the "diameter of the peripheral end 41" is the length of the largest segment passing through two points of the peripheral end 41.

The bottom 42 has a dome shape, the concavity of the dome being turned toward the inside.

The outer face 26B has a surface. The surface is called total surface S hereinafter.

The total surface S is equal to the sum of the surface of the side part 40 and the surface of the bottom 42.

For example, the total surface S of the outer face 26B of the diaphragm 26 is substantially equal to 820 $cm^2$ for a loudspeaker 10 having a diameter of 25 cm.

For example, the total surface S is equal to 1700 $cm^2$ for a loudspeaker 10 having a diameter of 30 cm.

The diaphragm 26 and the grid 30 are two separate parts.

This means that the grid 30 is an independent part added on the outer face 26B of the diaphragm 26.

Thus, the grid 30 is not integral with the diaphragm 26, that is to say, the grid 30 and the diaphragm 26 are not formed in a same part. They are two separate parts optionally connected to one another.

For example, the grid 30 is made from paper, graphite paper, bristol board, cardboard, polystyrene, polystyrene foam, expanded polystyrene, polypropylene, polypropylene foam, polymethyl methacrylate, a plastic material, Kevlar, polyester, glass, fiberglass, carbon fibers, cellulose fibers, banana fibers, wood, polyglass (registered trademark), or an aerogel.

As an illustration, the diaphragm 26 is also made from paper, graphite paper, bristol board, cardboard, polystyrene, polystyrene foam, expanded polystyrene, polypropylene, polypropylene foam, polymethyl methacrylate, a plastic material, Kevlar, polyester, glass, fiberglass, carbon fibers, cellulose fibers, banana fibers, wood, polyglass (registered trademark), or an aerogel.

According to one specific embodiment, the diaphragm 26 and the grid 30 are made from a separate material.

According to another specific embodiment, the diaphragm 26 and the grid 30 are made from a same material. In the case at hand, the diaphragm 26 and the grid 30 are, for example, made from cellulose fibers.

Broadly speaking, a grid 30 is a set of walls delimiting through spaces 44.

Each wall of the plurality of walls extends in a plane forming a non-zero angle with the outer face 26B of the diaphragm 26.

Each through space 44 comprises an inner passage, a first side and a second side.

The inner passage is delimited by wall portions from the set of walls.

Furthermore, the inner passage emerges on the first side and the second side. In other words, each through space 44 is open on the first side and the second side.

The first side delimits a first outer surface relative to the inner passage and the second side delimits a second outer surface relative to the inner passage.

The second outer surface is oriented in a direction pointed toward the outer face 26B of the diaphragm 26. Thus, the second outer surface is facing the outer face 26B of the diaphragm 26. In other words, it can be considered that the second side emerges on the outer face 26B of the diaphragm 26.

The first outer surface is arranged opposite the second outer surface. In practice, this means that the first outer surface is in contact with the atmosphere outside the loudspeaker 10.

Thus, each inner passage provides access to the outer face 26B of the diaphragm 26.

According to the example of FIG. 1, the grid 30 comprises an intersection of plates 50.

Figure 2:
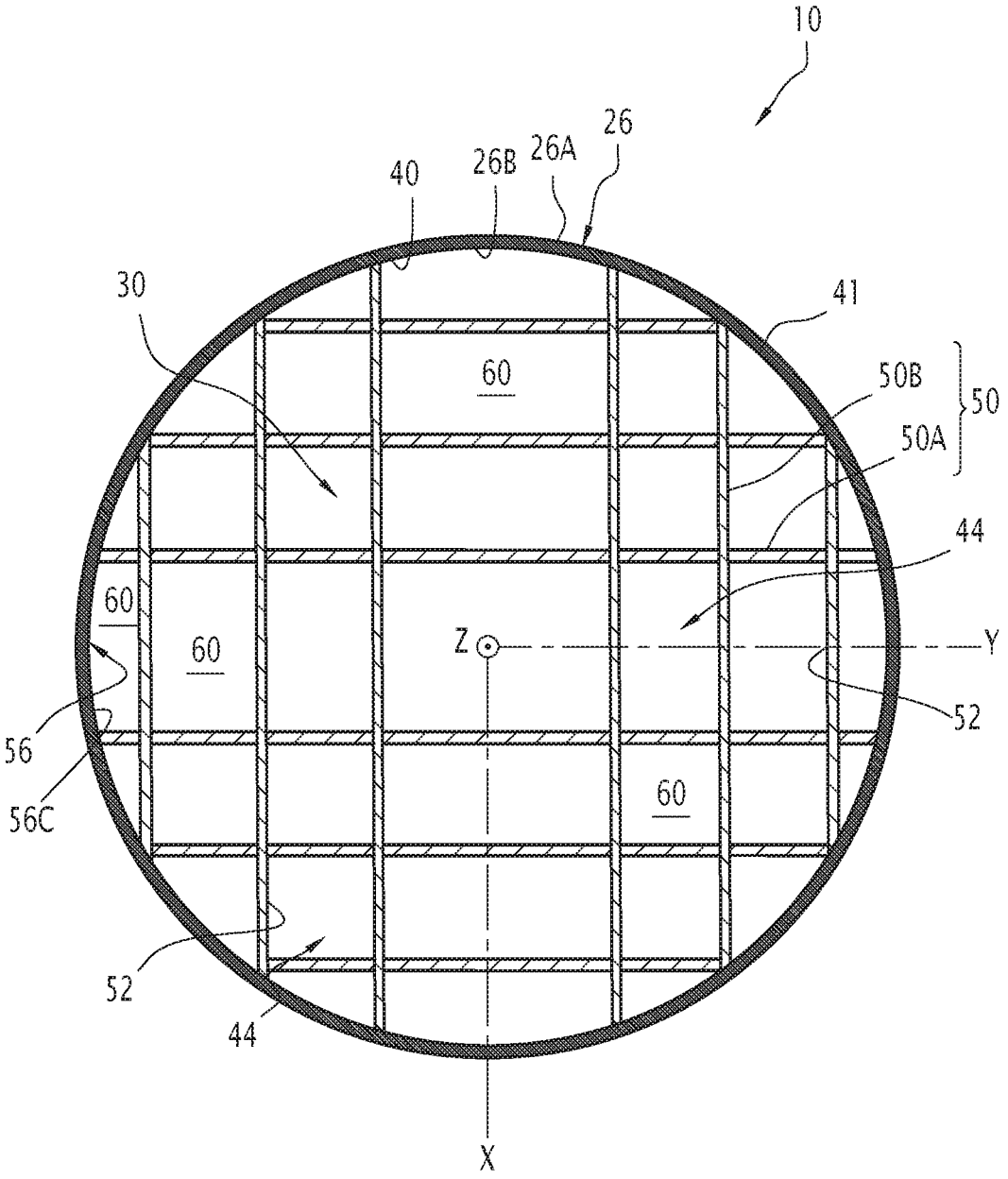

More specifically, as visible in FIG. 2, which is a view of the grid 30 in a section transverse to the movement direction Z, the grid 30 comprises transverse plates 50A and longitudinal plates 50B. The transverse plates 50A are parallel to the transverse direction Y, while the longitudinal plates 50B are parallel to the longitudinal direction X.

The grid 30 comprises at least two intersecting perpendicular plates 50, a transverse plate 50A and a longitudinal plate 50B.

In the exemplary embodiment of FIG. 2, the grid 30 comprises twelve intersecting plates 50, six transverse plates 50A and six longitudinal plates 50B.

In the case at hand, the transverse plates 50A and the longitudinal plates 50B delimit the through spaces 44.

As a result, most of the through spaces 44 are in the shape of a cylinder with a rectangular base. Each through space 44 is therefore delimited by a side wall. Furthermore, hereinafter, it is considered that it is possible to define a base 52 for each through space 44. The surface of the base 52 is denoted $S_B$ in the remainder of the description.

Each plate 50A, 50B extends between end edges 54, distributed between an outer end edge 54A, an inner end edge 54B and side end edges 54C.

The shape of the grid 30 is described hereinafter by the description of the shape of the volume formed by the surface connecting all of the end edges 54.

The volume formed by the surface connecting all of the end edges 54 corresponds, from a mathematical perspective, to the envelope 56 of the grid 30.

The envelope 56 of the grid 30 has an outer surface 56A, an inner surface 56B and a side surface 56C.

In the described example, the outer 56A and inner 56B surfaces are planar and extend in a plane normal to the movement direction Z.

The side surface 56C has a shape complementary to the diaphragm 26.

More specifically, the side surface 56C has a shape complementary to the side part 40 of the diaphragm 26.

In the case at hand, the side surface 56C has, in section, a substantially trapezoidal shape when the section is transverse to the longitudinal direction X, marrying the shape of the side part 40. In other words, the side surface 56C has a frustoconical shape.

Furthermore, as shown in FIG. 2, the side surface 56C has a circular shape in cross-section (relative to the movement direction Z).

To be still more precise, the side surface 56C has a shape complementary to the side part 40 of the outer face 26B of the diaphragm 26.

The side surface 56C of the envelope 56 of the grid 30 is between 60% of the total surface S and 95% of the total surface S.

The grid 30 has a shape allowing the grid 30 to be glued on the outer face 26B of the diaphragm 26.

This means that the grid 30 has side end edges 54C glued to the outer face 26B of the diaphragm 26, that is to say, side end edges 54C in contact with the outer face 26B.

In this sense, it should be noted that the side surface 56C is the surface connecting the side end edges 54C, that is to say, the side end edges 54C of the plates 50, which are glued to the outer face 26B.

In the example of FIG. 1, the grid 30 is glued on a part of the side part 40 and is not glued on the dome 34.

In such a case, the side surface 56C of the envelope 56 of the grid 30 is the total surface S.

In other exemplary embodiments, the grid 30 is glued on the entire outer face 26B, that is to say, both on the side part 40 and on the bottom 42.

In such a case, the inner surface 56B and the side surface 56C of the envelope 56 of the grid 30 is the total surface S. In this sense, it should be noted that the inner surface 56B is the surface connecting the inner end edges 54B of the plates 50.

The grid 30 is suitable for stiffening the diaphragm 26 and constraining its movements.

The grid 30 makes it possible to stiffen the diaphragm 26 while delimiting portions 60 of the outer face 26B, whose surface $S_P$ is smaller than the total surface S of the outer face 26B of the diaphragm 26.

More specifically, a portion 60 of the outer face 26B is the orthogonal projection of the base 52 of a through space 44 on the outer face 26B.

In some cases, it should be noted that a part of the portion 60 is located on the bottom 42 and the other part is located on the side part 40.

In the case of FIGS. 1 and 2, each portion 60 of the outer face 26B has the same rectangular shape as the base 52 of the through spaces 44.

The number of portions 60 is greater than or equal to 4.

Advantageously, the number of portions 60 is equal to 10.

In the case of FIGS. 1 and 2, the number of portions 60 is equal to 37.

A portion surface $S_P$ is defined for each of the portions 60.

In the previously mentioned case where a part of the portion 60 is located on the bottom 42 and the other part of the portion 60 is located on the side part 40, the surface of the portion 60 is the sum of the surface of each of the parts.

In the remainder of the description, the surface of a portion 60 of the outer face 26B of the diaphragm 26 is denoted $S_P$.

Each portion 60 has a surface $S_P$ of less than or equal to 25% of the total surface S, preferably less than or equal to 20% of the total surface S, and advantageously less than or equal to 10% of the total surface S.

For example, the surface $S_P$ of the portions 60 is substantially equal or equal to the surface $S_B$ of the base 52 of a through space 44. More specifically, the surface $S_P$ of the portions 60 is a function of the number of intersecting plates 50.

At least some portions 60 have the same portion surface $S_P$, preferably all of the portions 60 have the same portion surface at least in the central part (the portions located on the periphery being able to be incomplete).

In this case, the grid 30 delimits portions 60 of equal surface $S_P$ at least over part of the outer face 26B of the diaphragm 26.

The plates 50 of the grid 30 are, for example, made from paper, graphite paper, bristol board, cardboard, polystyrene, polystyrene foam, expanded polystyrene, polypropylene, polypropylene foam, polymethyl methacrylate, a plastic material, Kevlar, polyester, glass, fiberglass, carbon fibers, cellulose fibers, banana fibers, wood, polyglass (registered trademark), or an aerogel.

The aforementioned list of materials is not limiting. Another lightweight and rigid material could be appropriate.

The plates 50 are made from a same material.

In a variant, the plates 50 are made from different materials.

The end edges 54 of the plates delimit a solid part. In this case, the side walls of the cylinders forming the through spaces 44 form solid parts.

In a variant, the end edges 54 of the plates 50 delimit an open-worked part, that is to say, a part having at least one opening. In this case, at least one of the side walls of the cylinders forming the through spaces 44 forms an open-worked part.

Each plate 50 for example has eight openings. The openings for example have a circular shape in a section transverse to the longitudinal direction X.

In other words, the plates 50 for example have holes making it possible to lighten the grid 30.

The plates 50 have an open-worked part making it possible to adapt the weight of the grid 30 to a desired weight and to lighten the grid 30.

In a variant, the grid 30 comprises a different number of plates 50.

For example, the grid 30 comprises six plates 50, three longitudinal plates and three transverse plates, delimiting sixteen through spaces 44 between them.

The number of plates 50 of the grid 30 depends on the total surface S of the diaphragm 26. The larger the total surface S of the diaphragm 26 is, the more plates 50, for example, the grid 30 comprises. In other words, the number of plates 50 depends on the diameter of the loudspeaker 10.

The operation of the loudspeaker 10 will now be described.

The operation of the loudspeaker 10 is similar to that of a typical electrodynamic loudspeaker in which the movement of the diaphragm 26 makes it possible to obtain the desired sound.

However, when the diaphragm 26 moves in the movement direction Z, the grid 30 moves with the diaphragm 26.

The grid 30 being suitable for stiffening the diaphragm 26, it is a stiffened diaphragm 26 that moves in the movement direction Z.

As a result, the portions 60 of the outer face 26B of the diaphragm 26 delimited by the grid 30 delimit the diaphragm 26 in small diaphragm 26B portions 60 that are no longer the seat of standing waves. The diaphragm 26 is thus formed to move only in the movement direction Z. In other words, the diaphragm 26 is forced to move as a "piston".

As a result, the sound reproduction quality of the loudspeaker 10 is no longer limited by the presence of the standing waves in the diaphragm 26.

The loudspeaker 10 provided with the grid 30 therefore has a better sound reproduction quality.

Furthermore, the grid 30 is light.

Figure 3:
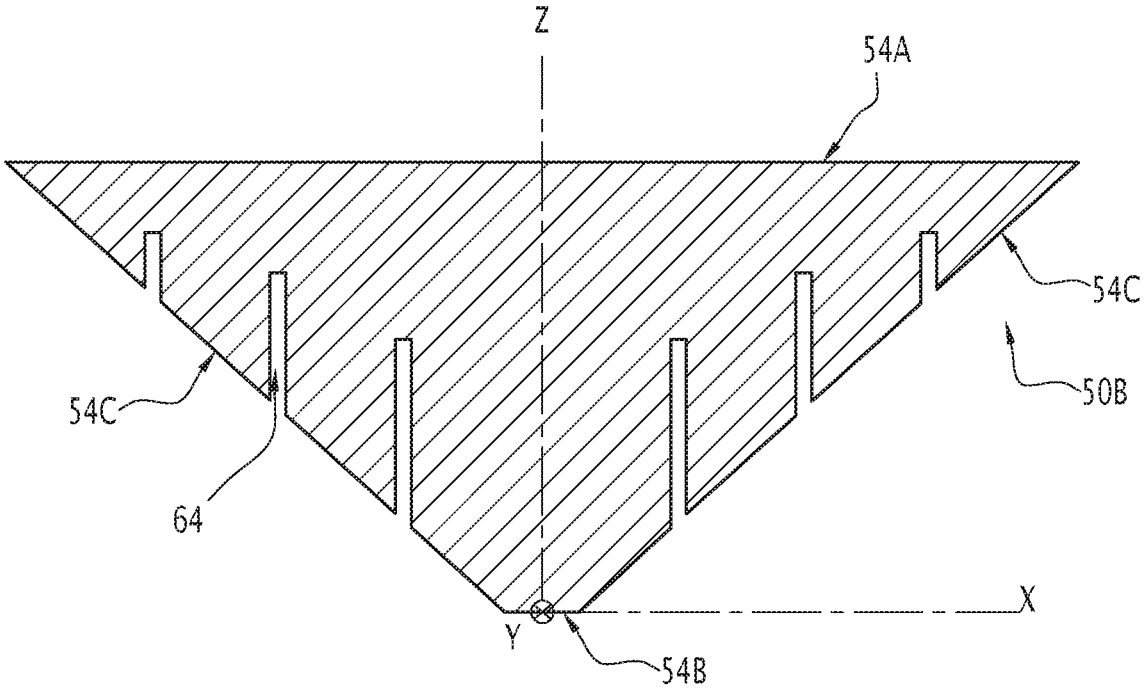
Figure 4:
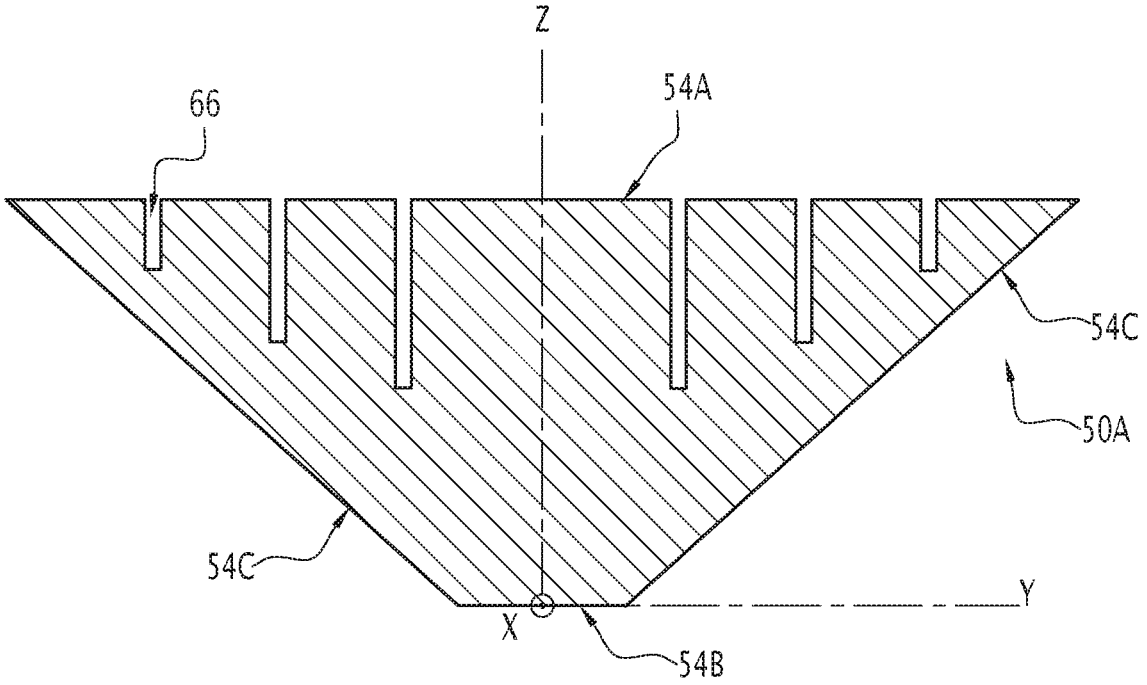

Additionally, the manufacture of the grid 30 is easy, as illustrated in reference to FIGS. 3 and 4.

Furthermore, the grid 30 is easy to mount on an existing loudspeaker provided with a diaphragm. This makes it possible to allow any loudspeaker provided with a diaphragm 26 to benefit from such a grid 30 by simply adding the grid 30.

In particular, the grid 30 is easy to mount on an existing loudspeaker, in particular by gluing.

According to one specific embodiment, the grid 30 is formed by the nesting of several plates 50.

FIGS. 3 and 4 respectively show a longitudinal plate 50B and a transverse plate 50A of the grid 30 each provided with grooves 64, 66.

For example, the longitudinal plates 50B and the transverse plates 50A respectively comprise six grooves 64, 66.

Each groove 64 of each longitudinal plate 50B is nested in a groove 66 of a transverse plate 50A.

In this example, when the plates 50A, 50B are nested, the side wall of the cylinder with a rectangular base delimiting the through spaces 44 forms a solid part.

Figure 5:
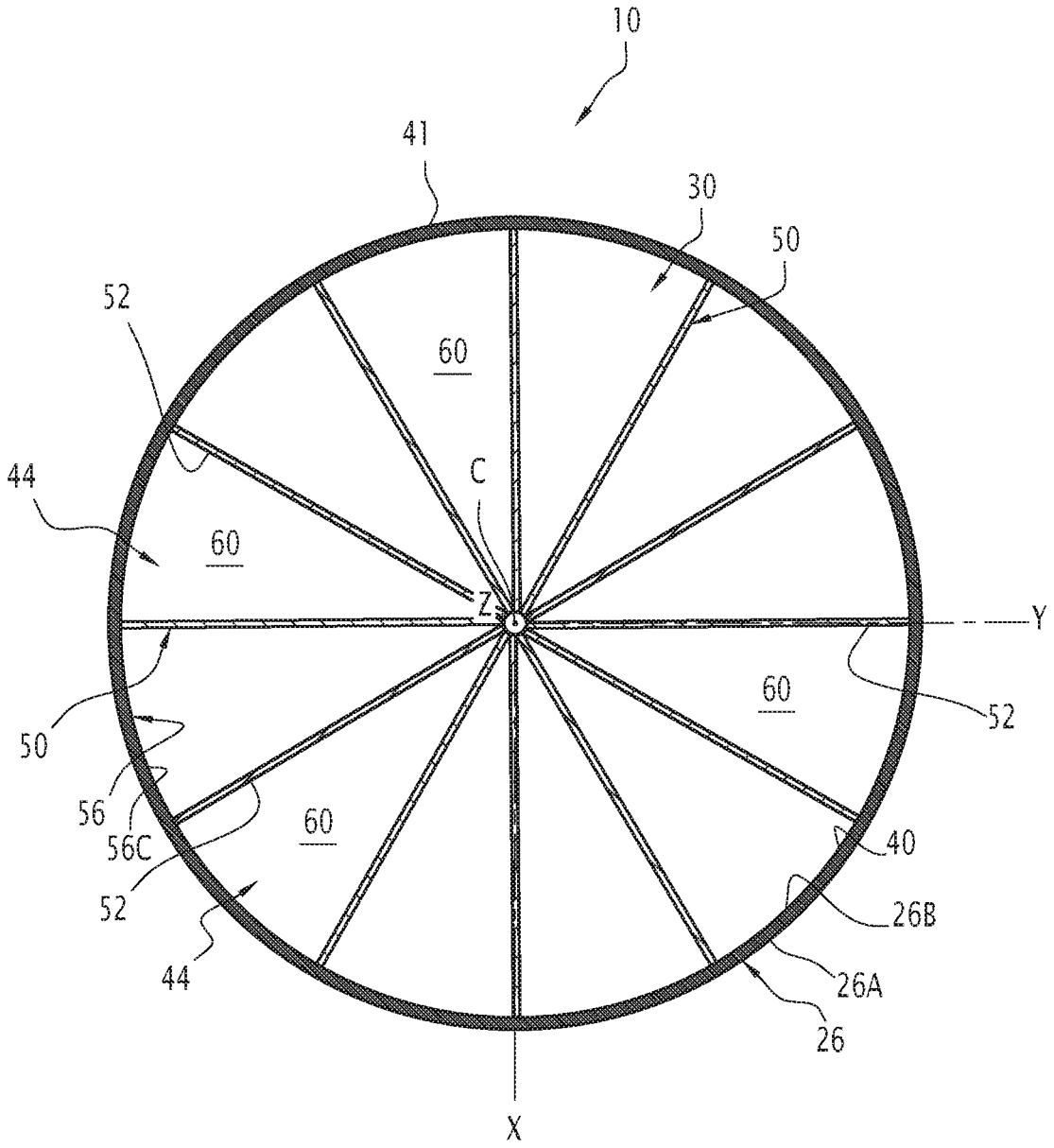

FIG. 5 corresponds to another embodiment of the invention.

This embodiment is described in terms of how it differs from the embodiments of FIGS. 1 to 4.

More specifically, as visible in FIG. 5, which is a view of the grid 30 in a section transverse to the movement direction Z, the grid 30 comprises plates 50 arranged in a "star".

The envelope 56 of the grid 30 has a circular shape.

The plates 50 are concurrent at a same point C in space belonging to the axis Z of the loudspeaker 10.

The plates 50 are angularly offset relative to one another with respect to the axis Z.

The plates 50 are for example angularly offset relative to one another by 30 degrees with respect to the axis Z.

The through spaces 44 are in the shape of a cylinder with a triangular base. The base 52 of the through spaces 44 is substantially in the shape of a triangle.

The grid 30 delimits through spaces 44 with a same shape and same size.

Thus, the portions 60 of the outer surface 26B of the membrane 26 have identical surfaces $S_P$.

According to another embodiment, the plates 50 of the grid 30 have a honeycomb shape along a section transverse to the movement direction Z. In other words, the plates 50 of the grid 30 delimit through spaces 44, the base 52 of which is in the form of a honeycomb cell.

Thus, the portions 60 of the outer face 26B of the membrane 26 are substantially in the shape of a honeycomb cell.

Although the grid 30 described in the present application is formed by the nesting of plates 50, the grid 30 could be made differently.

For example, the grid 30 is formed by securing plates 50 edge to edge.

According to still another example, the grid 30 is formed in a single piece.

The invention claimed is:

1. A loudspeaker comprising:

a frame, a device for generating a magnetic field in a magnetic circuit exhibiting an air gap, turns of conductive materials for moving in said air gap, a diaphragm that is rigidly connected to the turns of conductive materials and moves in a direction of movement with respect to the frame, the diaphragm having an inner face and an outer face, the inner face of the diaphragm being positioned facing the frame, the outer face comprising a side part having a frustoconical shape, a shape having at least a portion of a paraboloid or a shape having at least a portion of a hyperboloid, and, in at least one plane perpendicular to said direction of movement, the side part having a circular or an elliptical shape, and a grid that is intended to stiffen the diaphragm, the grid comprising a set of intersecting walls, wherein the grid and the diaphragm are distinct from each other, wherein, the shape of the grid allows the grid to be glued to the outer face of the diaphragm, and wherein the grid is attached to the outer face of the diaphragm by gluing.

2. The loudspeaker according to claim 1, wherein the outer face of the diaphragm has a surface, called total surface, the grid delimits portions of the outer face of the diaphragm, each portion having a surface of less than or equal to 25% of the total surface, preferably less than or equal to 20% of the total surface, and advantageously less than or equal to 10% of the total surface.

3. The loudspeaker according to claim 1, wherein the outer face of the diaphragm has a surface, called total surface, the grid delimits portions of the outer face of the diaphragm, the number of portions being greater than or equal to 10.

4. The loudspeaker according to claim 1, wherein the grid delimits portions of equal surface at least over part of the outer face of the diaphragm.

5. The loudspeaker according to claim 1, wherein the grid is formed by the nesting of several plates.

6. The loudspeaker according to claim 5, wherein the grid comprises at least two nested plates.

7. The loudspeaker according to claim 5, wherein the grid verifies at least one of the following properties:

a first property according to which the plates are parallel to a first direction or a second direction, the two directions being perpendicular to one another and perpendicular to the movement direction, a second property according to which the plates are concurrent at a same point in space, and a third property according to which the grid has a honeycomb shape in a section transverse to the movement direction.

8. The loudspeaker according to claim 5, wherein each plate is made from a material, the material of each plate is chosen from the group of materials made up of: paper, graphite paper, bristol board, cardboard, wood, polystyrene, polystyrene foam, expanded polystyrene, polypropylene, polypropylene foam, polyester, polymethyl methacrylate, a plastic material, Kevlar, glass, fiberglass, carbon fibers, cellulose fibers, banana fibers, and an aerogel.

9. The loudspeaker according to claim 8, wherein each plate is made from a same material.

10. The loudspeaker according to claim 5, wherein the plates define between them through spaces of the grid, each through space being delimited by a wall and at least one of the walls having at least one opening.

11. The loudspeaker according to claim 1, wherein the grid comprises a set of walls delimiting through spaces of the grid, each through space comprising an inner passage, a first side and a second side, the second side delimiting a second outer surface facing the outer surface of the diaphragm and the first side delimiting a first outer surface opposite the second outer surface.

12. A process for manufacturing a loudspeaker comprising:

providing a frame, providing a device for generating a magnetic field in a magnetic circuit exhibiting an air gap, providing turns of conductive materials for moving in said air gap, providing a diaphragm that is rigidly connected to the turns of conductive materials and that moves in a direction of movement with respect to the frame, the diaphragm having an inner face and an outer face, the inner face of the diaphragm being positioned facing the frame, the outer face comprising a side part having a frustoconical shape, a shape having at least a portion of a paraboloid or a shape having at least a portion of a hyperboloid and, in at least one plane perpendicular to said direction of movement, the side part having a circular or an elliptical shape;

providing a grid to stiffen the diaphragm, the grid and the diaphragm being different from each other and the shape of the grid allowing the grid to be glued to the outer face of the diaphragm; and gluing the grid to the outer face of the diaphragm.

13. A loudspeaker comprising:

a frame, a device for generating a magnetic field in a magnetic circuit exhibiting an air gap, turns of conductive materials for moving in this air gap, a diaphragm that is rigidly connected to the turns of conductive materials and that moves in a direction of movement with respect to the frame, the diaphragm having an inner face and an outer face, the inner face of the diaphragm being positioned facing the frame, the outer face comprising a side part having a frustoconical shape, a shape having at least a portion of a paraboloid or a shape having at least a portion of a hyperboloid and, in at least one plane perpendicular to said direction of movement, the side part having a circular or an elliptical shape, and a reinforcement of the diaphragm to stiffen the diaphragm, wherein the reinforcement and the diaphragm are different from each other, wherein the shape of the reinforcement allows the reinforcement to be glued to the outer face of the diaphragm wherein the reinforcement comprises a set of intersecting walls delimiting through spaces of the reinforcement, the reinforcement delimiting an outer surface, an inner surface and a side surface, the outer surface and the inner surface being perpendicular to the direction of movement, and the side surface joining the outer face and the inner face, wherein the side surface of the reinforcement has a shape complementary to the shape of the side part of the diaphragm, wherein at least one of the intersecting walls has at least one opening, and wherein the side surface of the reinforcement is glued on the side part of the diaphragm.

* * * * *